US006076540A

United States Patent [19]

You

[11] Patent Number: 6,076,540

[45] Date of Patent: Jun. 20, 2000

[54] COLLAPSIBLE FRAME STRUCTURE FOR SELF-OPENING UMBRELLA

[76] Inventor: Ching-Chuan You, C/O Percy International Patent Corp. P.O. Box 1-79, Taipei, Taiwan

[21] Appl. No.: 09/100,864

[22] Filed: Jun. 22, 1998

[30] Foreign Application Priority Data

Apr. 24, 1998 [TW] Taiwan ..... 87206352

[51] Int. Cl.[7] ..... A45B 25/16

[52] U.S. Cl. ..... 135/22; 135/28; 135/29

[58] Field of Search ..... 135/22, 28.32

[56] References Cited

U.S. PATENT DOCUMENTS 3,732,881 5/1973 Hirai ..... 135/22

3,746,025 7/1973 Murata ..... 135/22

5,472,006 12/1995 Kuo ..... 135/31

5,829,462 11/1998 Cho ..... 135/22

*Primary Examiner*—Beth Aubrey

[57] ABSTRACT

A durable collapsible frame structure is provided for umbrella with self-opening mechanism, which can make the pivotal coupling between the supporting ribs and the linkage beams highly firm and secure while nonetheless retaining the light-weighted quality of the supporting ribs. The collapsible frame structure is more durable than the prior art by using enforced light-weighted materials such as FRP to form the umbrella frame and steel bars to form the linkage beams. Therefore, the collapsible frame structure is longer in the life of use than the prior art.

1 Claim, 4 Drawing Sheets

COLLAPSIBLE FRAME STRUCTURE FOR SELF-OPENING UMBRELLA

BACKGROUND OF THE INVENTION

1. Field of the Invention

This invention relates to umbrellas, and more particularly, to a collapsible frame structure for umbrella with self-opening mechanism that allows the umbrella, after being collapsed, to be opened automatically without manual effort from the user. The particular design of the collapsible frame structure allows the umbrella to be longer in life of use than the prior art.

2. Description of Related Art

A collapsible umbrella (also called a foldable umbrella) allows the user to collapse the umbrella when the umbrella is not in use for easy storage or carriage. Collapsible umbrellas are typically provided with a self-opening mechanism that allows the umbrella, after being collapsed, to be opened automatically without manual effort from the user. Conventional collapsible umbrellas, however, can easily fail in the self-opening mechanism due to a poor structure in the collapsible frame structure, which will be illustratively described in the following with reference to FIG. 4.

FIG. 4 shows a conventional collapsible frame structure for a self-opening umbrella. As shown, the collapsible frame structure for self-opening umbrella includes a main shaft 100, a bottom running hub 101, a spiral spring 102, an intermediate running hub 103, an upper running hub 104, a radiating frame of main ribs 105 (only one is shown), a frame of supporting ribs 106 (only one is shown), and a frame of linkage beams 108 (only one is shown). The upper running hub 104 is fixed on the top of the main shaft 100. The bottom running hub 101 and the intermediate running hub 103 are slidably mounted on the main shaft 100, with the spiral spring 102 mounting between the bottom running hub 101 and the intermediate running hub 103 for providing a self-opening force for the umbrella. The main ribs 105 each radiates from the upper running hub 104 to form a frame for supporting the shielding fabric (not shown) of the umbrella. The supporting ribs 106 each radiates from the intermediate running hub 103 to support one of the main ribs 105; and the linkage beams 108 are each connected between the bottom running hub 101 and the mid-point of one of the supporting ribs 106, such that when the bottom running hub 101 is pulled down, the linkage beams 108 can draw the supporting ribs 106 and thus the main ribs 105 downwards to collapse the umbrella. Each linkage beam 108 is affixed to the associated supporting rib 106 by means of a pin 109 which is fastened in position through holes 1061 formed in the middle portion of the supporting ribs 106 and a hole 108A formed in the end of the linkage beam 108. The supporting ribs 106 are typically made from a light-weight metal into thin, substantially U-shape pieces for the purpose of making the umbrella light-weighted. The self-opening mechanism of the umbrella is driven by the spiral spring 102, which will be compressed when the umbrella is collapsed.

One drawback to the foregoing collapsible frame structure of FIG. 4, however, is that during the operation of the self-opening mechanism, a quite amount of force applied from the restoration of the compressed spiral spring 102 to uncompressed state can cause the pin 109 and the holes 1061 to be deformed and loosened from position gradually from time to time, thus using for a period of time, it will break apart the connection between the linkage beams 108 and the supporting ribs 106. This is because that the supporting ribs 106 are made from thin and light-weighted metal pieces, which makes the pivotal coupling between the supporting ribs 106 and the linkage beams 108 by means of the pin 109 and the holes 1061 to be quite vulnerable and insecure.

When the pivotal coupling between the linkage beams 108 and the supporting ribs 106 are broken, the umbrella would no longer be usable.

SUMMARY OF THE INVENTION

It is therefore an objective of the present invention to provide a collapsible frame structure for self-opening umbrella, which can make the pivotal coupling between the supporting ribs and the linkage beams highly firm and secure while nonetheless retaining the light-weighted quality of umbrella, allowing the umbrella to have the benefits of easy portability and long life of use.

It is another objective of the present invention to provide a collapsible frame structure for self-opening umbrella, which can make the pivotal coupling between the supporting ribs and the linkage beams very easily and fast to carry out during assembly in factory without having to use pins.

In accordance with the foregoing and other objectives of the present invention, an improved collapsible frame structure is provided for self-opening umbrella. The collapsible frame structure of the invention includes:

a main shaft;

a bottom running hub slidably mounted on the main shaft;

an intermediate running hub slidably mounted on the main shaft;

an elastic member mounted on the main shaft between the bottom running hub and the intermediate running hub;

an upper running hub slidably mounted on the main shaft;

a plurality of main ribs, each being made from fabric reinforced plastics (FRP) material and having one end linked to the upper running hub;

a plurality of supporting ribs, each being made from FRP and having a first linking member formed at one end thereof for connection to the main rib and a second linking member formed at the other end thereof for linking to the intermediate running hub;

a plurality of linkage beams, each being made from a steel bar formed with a bottom hook for connection to the bottom running hub and an upper hook for coupling to the associated supporting rib;

a first pivotal-coupling device for coupling the outer end of each supporting rib to the associated main rib, the first pivotal-coupling device including a tubular member for the main rib to pass therethrough and at least one ear formed with a hole for pivotal connection to the first linking member of the supporting rib; and a second pivotal-coupling device made through injection molding with nylon plastics, including a linking member and a double-bar beam portion, with the linking member being formed with a coupling hole for hooking with the upper hook of each linkage beam.

The foregoing collapsible frame structure is more durable than the prior art by using enforced plastics to form the umbrella frame and steel bars to form the linkage beams. The collapsible frame structure of the invention is therefore longer in the life of use than the prior art.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1:
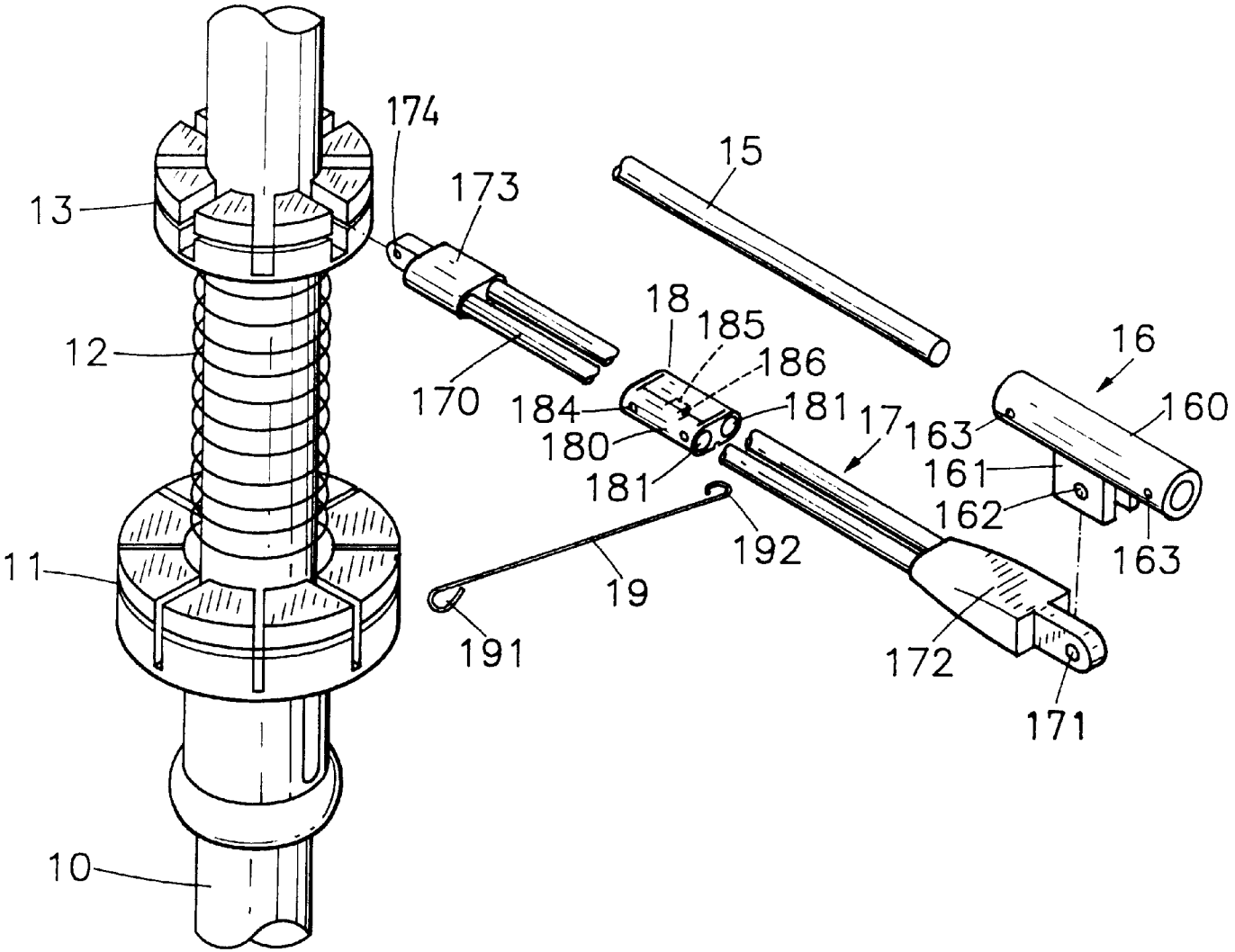
FIG. 1 is an exploded perspective view of the collapsible frame structure according to the invention for self-opening umbrella.
Figure 2:
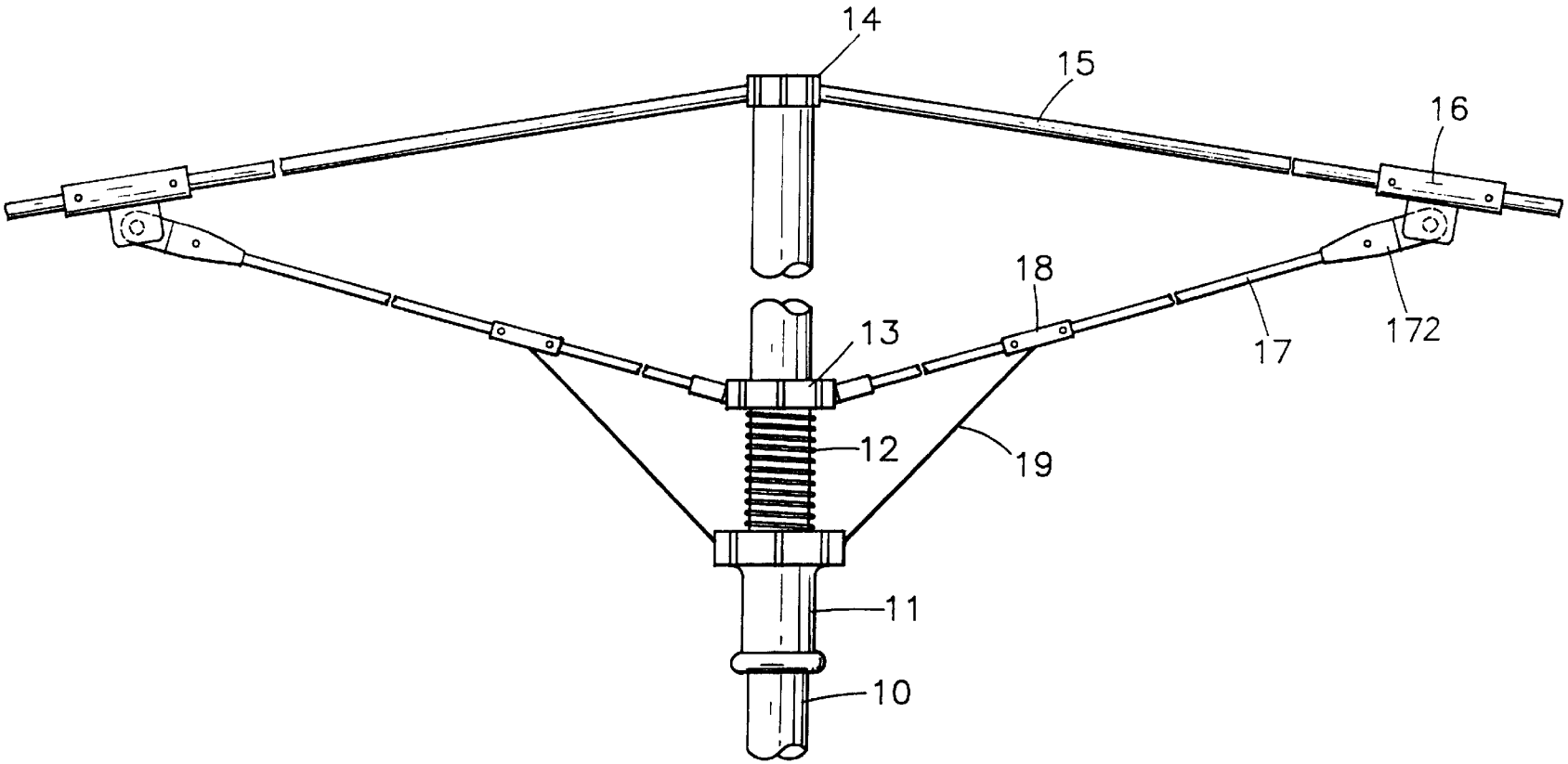
FIG. 2 is a front view of the collapsible frame structure of the invention when the umbrella is fully opened.
Figure 3:
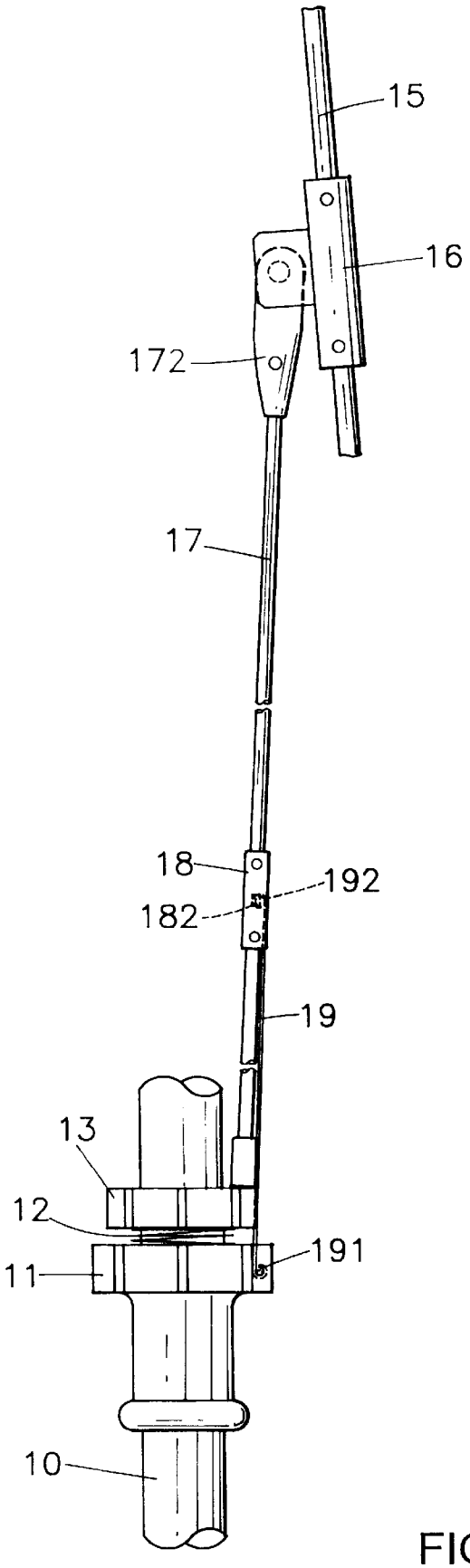
FIG. 3 is a front view of the collapsible frame structure of the invention when the umbrella is collapsed.
Figure 4:
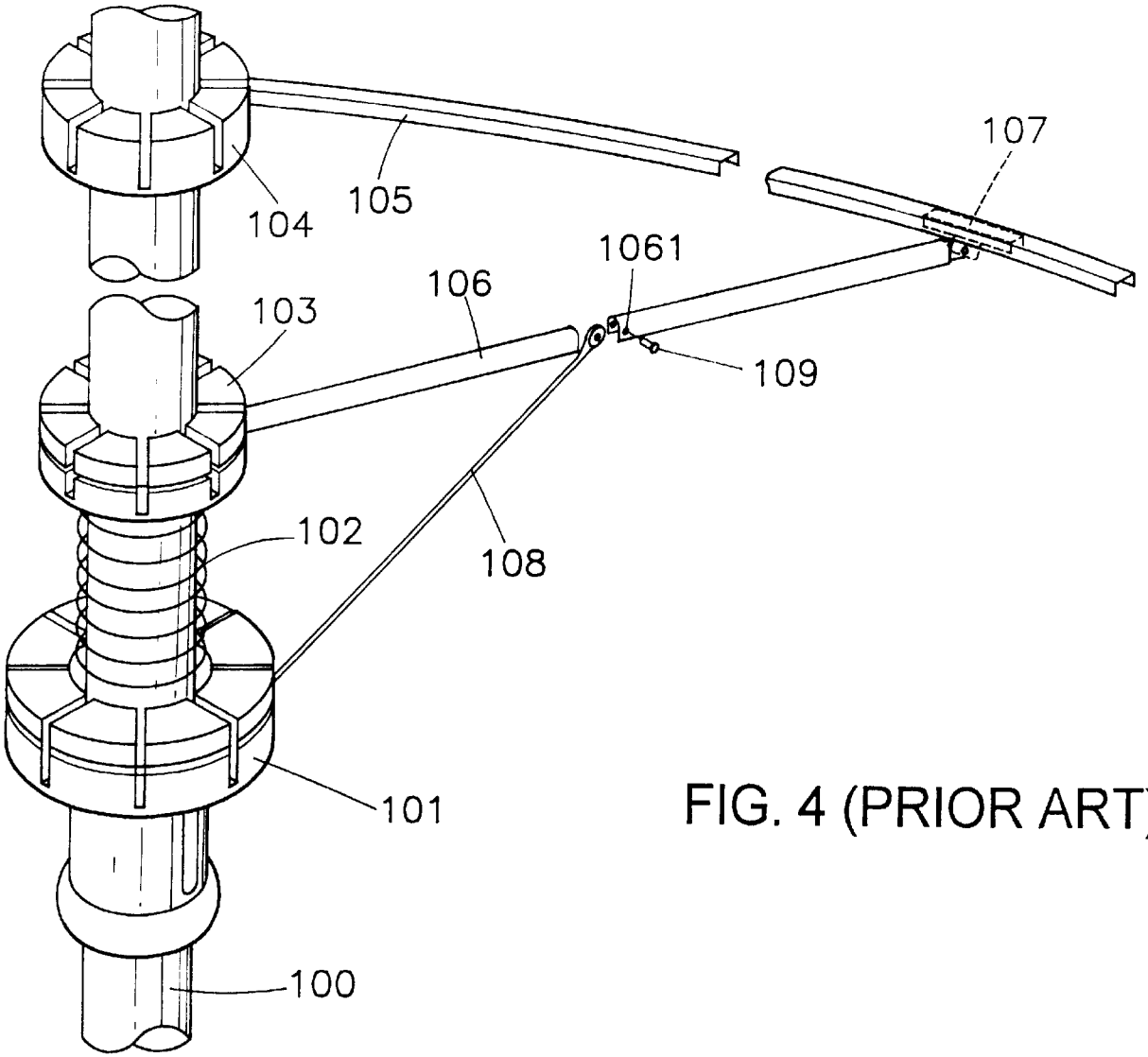
FIG. 4 (PRIOR ART)
FIG. 4 is a perspective view of a conventional collapsible frame structure for umbrella with self-opening mechanism.

A preferred embodiment of the collapsible frame structure according to the invention is illustrated in FIGS. 1–3. As shown, the collapsible frame structure of the invention includes a main shaft 10, a bottom running hub 11, an elastic member such as a spiral spring 12, an intermediate running hub 13, an upper running hub 14, a radiating frame of main ribs 15 (only one is shown), a first pivotal-coupling device 16, a frame of supporting ribs 17 (only one is shown), a second pivotal coupling device 18, and a frame of linkage beams 19 (only one is shown). The first pivotal-coupling device 16 is served to couple each supporting rib 17 to the associated main rib 15.

The collapsible frame structure of the invention is characterized in the provision of the second pivotal-coupling device 18 for coupling each supporting rib 17 to the associated linkage beam 19. Moreover, for the purpose of making the umbrella more light-weighted, the main rib 15 and the supporting rib 17 are all made from an enforced light-weighted material, such as fabric reinforced plastics (FRP), while the first pivotal-coupling device 16 on the main rib 15 and the second pivotal-coupling device 18 on the supporting rib 17 are formed by injection molding with nylon plastics.

The supporting rib 17 has one end formed with a first linking member 172 and the other end formed with a second linking member 173, with the first and second linking members 172, 173 each formed with a hole 171, 174 for coupling the beam portion of the supporting rib 17 (the beam-portion of the supporting rib 17 is a double-bar structure 170 including two parallel bars) to the inter mediate running hub 13 and the first pivotal-coupling device 16, respectively. Adhesives or ultrasonic wave welding techniques can be used to combine the main rib 15 and the supporting rib 17 with the pivotal-coupling devices. The first pivotal-coupling device 16 includes a tubular member 160 formed with a pair of holes 163 and a pair of ears 161, with each of the ears 161 being formed with a hole 162. The first pivotal-coupling device 16 allows the supporting rib 17 to be pivotally coupled to the main rib 15. The supporting rib 17 and the first and second linking members 172, 173 are also formed through injection molding with nylon plastics. The linkage beam 19 is made from a steel bar which is bent into the shape shown in FIG. 1 with a bottom hook 191 at one end and an upper hook 192 at the other end. The second pivotal-coupling device 18 includes a linking member 180 having two parallel through holes 181 formed therein. The through holes 181 allow the double-bar beam portion 170 of the supporting rib 17 to pass therethrough. Moreover, the linking member 180 is formed with two spots 184, where holes for filling adhesive or welding means can be provided for securing the double-bar beam portion 170 to the linking member 180. Further, the linking member 180 is formed with a coupling hole 186 in the middle portion 185 thereof for hooking with the upper hook 192 of the linkage beam 19, allowing the linkage beam 19 to be pivotally coupled to the supporting rib 17.

In assembly, the inner end of the main rib 15 is coupled to the upper running hub 14; the inner end of the supporting rib 17 is coupled to the intermediate running hub 13 and the outer end of the same is coupled by means of the first pivotal-coupling device 16 to the middle of the main rib 15; and the linkage beam 19 is connected to the second pivotal-coupling device 18 by hooking the upper hook 192 thereof to the coupling hole 186 of the linking member 180 and to the bottom running hub 11 by hooking the bottom hook 191 thereof to the bottom running hub 11. The self-opening mechanism of the invention is the same as the prior art, so description thereof will not be further detailed.

In conclusion, the invention provides an improved collapsible frame structure that is more durable than the prior art by using enforced plastics to form the umbrella frame and steel bars to form the linkage beams. The collapsible frame structure of the invention is therefore longer in the life of use than the prior art.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A collapsible frame structure for an umbrella with a self-opening mechanism, which comprises:

a main shaft;

a bottom running hub slidably mounted on the main shaft;

an intermediate running hub slidably mounted on the main shaft;

an elastic member mounted on the main shaft between the bottom running hub and the intermediate running hub;

an upper running hub fixedly mounted on a top of the main shaft;

a plurality of main ribs, each being made from enforced FRP and having one end linked to the upper running hub;

a plurality of supporting ribs, each being made from enforced FRP and having a first linking member formed at one end thereof connected to the main rib and a second linking member formed at the other end thereof linked to the intermediate running hub;

a plurality of linkage beams, each being made from a steel bar formed with a bottom hook connected to the bottom running hub and an upper hook coupled to each of the supporting ribs;

a plurality of first pivotal-coupling devices, each coupling an outer end of each of the supporting ribs to each of the main ribs, each of the first pivotal-coupling devices including a tubular member to have each of the main rib to pass therethrough and at least one ear formed with a hole pivotally connected to each of the first linking members of the supporting ribs; and a plurality of second pivotal-coupling devices each being made through injection molding with nylon plastics, each device including a linking member having two parallel through holes formed therein to allow a double-bar beam portion of each of the supporting ribs to pass through, said linking member being formed with a coupling hole in a middle portion thereof to hook with the upper hook of each of the linkage beams, allowing each of the linkage beams to be pivotally coupled to each of the supporting ribs.

* * * * *